US006325732B1

(12) United States Patent
Ankeny

(10) Patent No.: US 6,325,732 B1
(45) **Date of Patent: *Dec. 4, 2001**

(54) BROOM BALL STICK

(76) Inventor: Scott B. Ankeny, 30664 Hayes La., Junction City, OR (US) 97448

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/246,033

(22) Filed: Feb. 6, 1999

Related U.S. Application Data

(60) Provisional application No. 60/073,966, filed on Feb. 6, 1998.

(51) Int. Cl.[7] ..... A63B 59/14
(52) U.S. Cl. ..... 473/559
(58) Field of Search ..... 473/560–563, 473/508, 559, FOR 189

(56) References Cited

U.S. PATENT DOCUMENTS

| | | | | |
|---|---|---|---|---|
| 3,671,038 | * | 6/1972 | Liard | 473/558 |
| 4,222,562 | * | 9/1980 | Gardner | 273/67 R |
| 5,674,141 | * | 10/1997 | Laforest | 473/559 |
| 5,718,647 | * | 2/1998 | Titola | 473/562 |

FOREIGN PATENT DOCUMENTS

| | | | | |
|---|---|---|---|---|
| 935442 | * | 8/1963 | (GB) | 473/FOR 189 |

* cited by examiner

*Primary Examiner*—Mark S. Graham

(57) ABSTRACT

An improved broom ball stick. Features include a stronger shaft that penetrates further into the head than conventional sticks to reduce head break off. The head end of the shaft is preferably tapered to accommodate a tapered head design. Ball control protrusions and stick reinforcing mechanisms are also disclosed.

17 Claims, 2 Drawing Sheets

BROOM BALL STICK

CROSS REFERENCE TO RELATED APPLICATIONS

This application claims the benefit of U.S. Provisional Application No. 60/073,966, filed Feb. 6, 1998, and having the same title and inventor(s) as above.

FIELD OF THE INVENTION

The present invention relates to broom ball sticks and heads for broom ball sticks and also to related sticks used in other sports.

BACKGROUND OF THE INVENTION

Broom ball is continually increasing in popularity. Factors related to the increase in popularity of broom ball include the building of ice rinks in more temperate regions, a societal move towards more health conscious activities and the growth of skating activities in general such as in-line skating and the like. In the state of Minnesota, for example, there are over 30,000 registered broom ball players.

Referring to FIGS. 1A–1B, front and side longitudinal views of a conventional broom ball stick 10 are respectively shown. Stick 10 consists of a shaft 12, often formed of aluminum, a wooden insert 14 and a rubberized head 16 which is formed about insert 14 and the base of shaft 12. The insert often extends into the shaft and the shaft normally extends about an inch into the head. The insert may be secured to the shaft with glue and possibly a bolt 18.

Insert 14 provides structural reinforcement of the head and gives a player better control of movement of the head. The insert is usually made of wood because wood can be readily machined to provide the necessary taper from the circular base of shaft 12 to the bottom edge of the head (shown in FIG. 1B).

A disadvantageous aspect of this configuration, however, is that these sticks tend to break where the wood insert enters the shaft. This break line is labeled A—A in FIGS. 1A–1B. The break line region of the stick receives maximum force during a slap shot or brace, etc. Another disadvantageous aspect of prior art broom ball sticks is that the aluminum shaft that is commonly used is insufficiently strong to withstand forces related to the game, such as a player falling on the stick and the like, and thus tends to bend too readily.

SUMMARY OF THE INVENTION

Accordingly, it is an object of the present invention to provide a broom ball stick with a shaft and head configuration that reduces the incidence of the head breaking off.

It is another object of the present invention to provide a broom ball stick in which the shaft extends further into the head than in prior art broom ball sticks.

It is another object of the present invention to provide a broom ball stick with at least one substantially straight head surface.

It is another object of the present invention to provide a broom ball stick with ball control protrusions formed on the outer surface of the head.

It is another object of the present invention to teach the retrofitting of a broken off head in such a manner that reduces the incidence of the head breaking off again.

It is also an object of the present invention to provide a broom ball stick that has a shaft that is lightweight and has increased resistance to bending.

These and related objects of the present invention are achieved by use of an improved stick for broom ball and related sports as described herein.

In one embodiment, a hollow metallic or the like material shaft (lightweight and durable) is provided that extends more deeply into a broom ball stick head than in prior art configurations. The increased penetration of the shaft into the head without altering the shape of the head may be achieved by retrofitting a broken-off head or by de novo formation with a longer metallic shaft.

Retrofitting may be achieved by drilling out portions of the original wooden insert and forming a new shaft that is tapered and is capable of descending further into the head than prior art configurations. A reinforcement shaft, fill material and glue are preferably provided within the tapered portion of the tapered shaft to provide structural reinforcement (while retaining a low overall weight). The reinforcement shaft is preferably connected to the remainder of the wooden insert to provide additional stability and control of the head.

One embodiment of de novo formation may be achieved by cutting a shaft in a unique pattern that permits bending and shaping into a tapered configuration that has structural integrity, extends as far into the head as desired (in place of the previously used wooden insert) and permits formation of heads having desired side profiles or side cuts as discussed below.

Another embodiment of de novo formation may be achieved by forming a shaft to have one side (that will ultimately be aligned with a head surface) that is substantially straight. The opposing surface is preferably tapered but may be straight or otherwise configured.

The present invention also includes the provision of ball control bumps or protrusion on the outside surface of the head.

In addition, the present invention includes methods for forming the retrofit and de novo embodiments.

The attainment of the foregoing and related advantages and features of the invention should be more readily apparent to those skilled in the art, after review of the following more detailed description of the invention taken together with the drawings.

DETAILED DESCRIPTION

While the present invention is particularly applicable to broom ball sticks, it should be recognized that the teachings of the present invention, particularly those relating to extending the shaft further into the head and the use of stick materials that resist bending, are applicable to all athletic sticks and the like to which forces are applied that cause the heads to break off or the sticks to bend.

Figure 2:
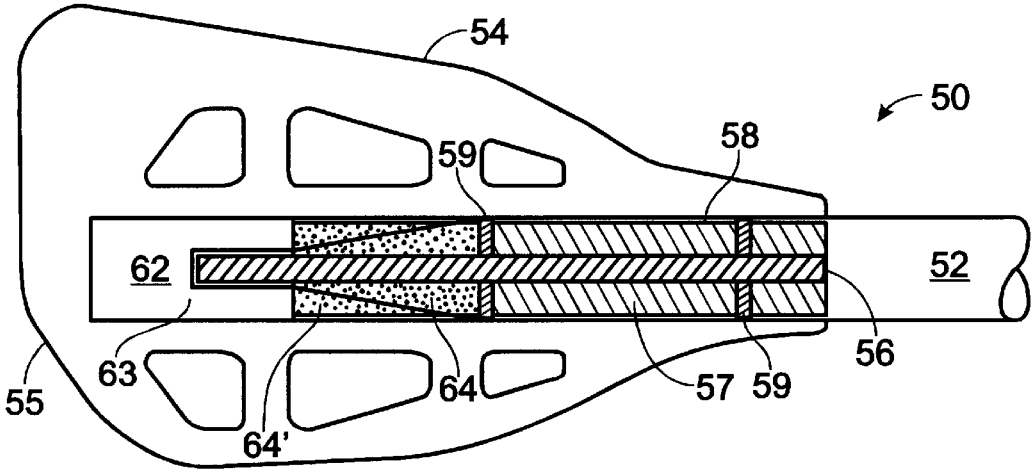
FIG. 2 is a front longitudinal view of the head portion of a retrofit broom ball stick in accordance with the present invention.

Referring to FIG. 2, a front longitudinal view of the head portion of a retrofit broom ball stick 50 in accordance with the present invention is shown. Stick 50 contains a shaft 52, a head 54, a reinforcement shaft 56, reinforcement and stabilizing material 58 and a shaft extender 62 which is preferably coupled to the reinforcement shaft. The shaft extender 62 is a remnant of the original wooden insert as discussed below.

Figure 1A:
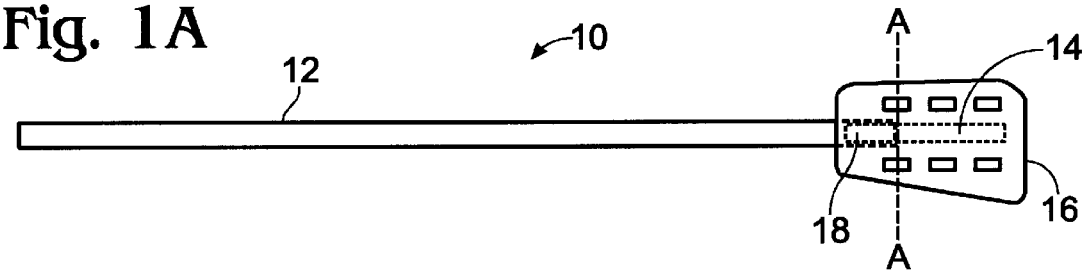
FIGS. 1A–1B are front and side longitudinal views, respectively, of a conventional broom ball stick.
Figure 1B:
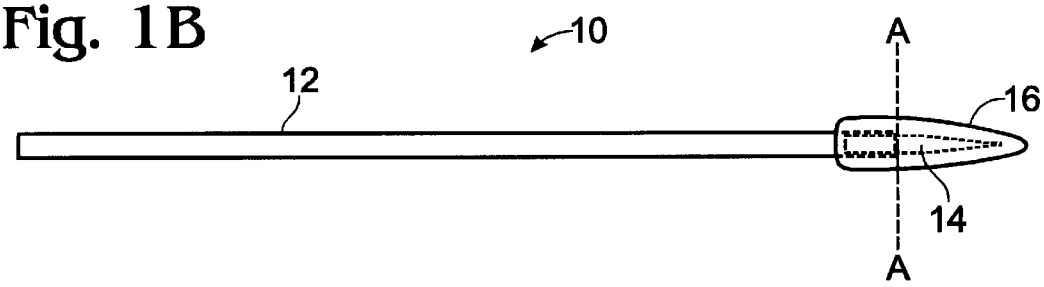

Shaft 52 may be made of aluminum, an aluminum alloy, titanium or like material. General characteristics of the material include that it is lightweight, durable and capable of being worked (e.g., cut and bent) to form a desired taper. While aluminum may be used, an aluminum alloy such as 6061 P6 aluminum (which is an aluminum, magnesium and silicon mix) is preferred because this and like alloys are stronger than pure aluminum and hence are less likely to bend. To eliminate fractures at the break line A—A (shown in FIG. 1) and to promote general stability and control, the metallic shaft is extended towards the bottom of edge 55 of the head. In this manner, the vulnerably located wood-metal interface of the prior art is eliminated and replaced by the intact metallic shaft.

Figure 3A:
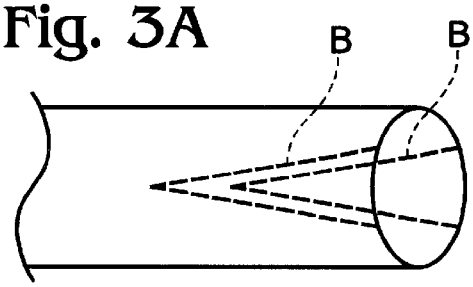
FIGS. 3A–3B are views illustrating formation of one embodiment of a tapered metallic shaft in accordance with the present invention.
Figure 3B:
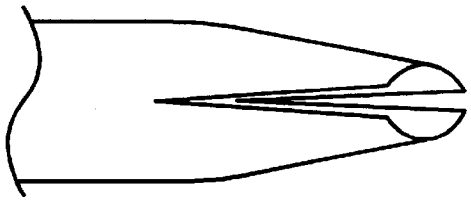

The tapered shaft is preferably formed by cutting wedges indicated by dashed lines B in FIG. 3A from a tube of starting material. The cut end of the shaft is then compressed to form the tapered shaft shown in FIG. 3B. Care should be taken in determining the length of cut lines B. If they penetrate too far into the tube the resultant structure may be undesirably fragile or brittle.

Reinforcement shaft 56 is preferably an aluminum alloy or like material and may be a tube or solid. Suitable tube dimensions include tubes with a one-quarter inch outer diameter and a 0.058 inch wall thickness. The reinforcement and stabilizing material is preferably provided between reinforcement shaft 56 and shaft 52. The reinforcement and stabilizing material may include any material or combination of materials that is lightweight and provides sufficient structural support. In a preferred embodiment, the material includes balsa wood 57 with interspersed washers 59. The balsa wood serves as a lightweight means of spacing and supporting the washers. The washers may be formed of plastic or metal or the like and are preferably configured to snugly fit over the reinforcement shaft and into shaft 52.

Glue or similar material 64 is preferably provided within the space between reinforcement shaft 56 and the tapered region of shaft 52 for providing additional stability to the reinforcement shaft. Glue 64' is also preferably provided in the cavity between the exterior of the tapered region of shaft 52 and the shaft extender 62.

Extender 62 is provided (or retained) at the end of reinforcement shaft 56 opposite shaft 52 and provides structural support towards the bottom edge of the head.

When stick 50 is formed by a retrofit, extender 62 will be made of wood that is left from the original stick (such as stick 10 of FIG. 1) and broken near line A—A. A large portion of the original broken off wood is then drilled out using a drill bit that is preferably slightly smaller in diameter than the wood to prevent accidental removal of material from the head. For example, if the insert is 1" in diameter, a ⅞" drill bit is used and the thin fragments of wood that remain are broken out with needle nose pliers. The wood is drilled out to a point that assures that the new shaft will completely fill the break line region. Extender 62 is then drilled on center to create a bore hole that receives reinforcement shaft 56.

Figure 4:
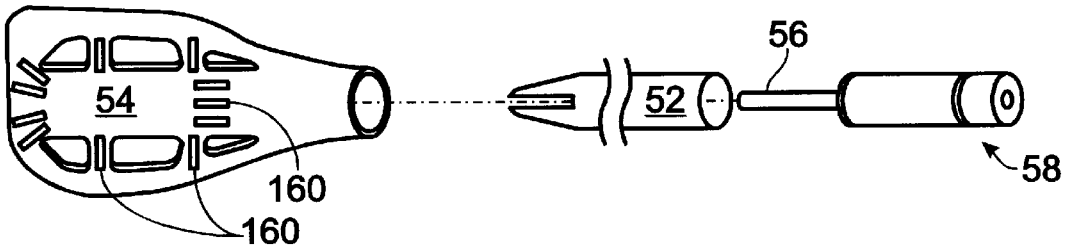
FIG. 4 is a perspective view of the retrofit formation technique in accordance with the present invention. Ball control bumps are also shown.

Referring to FIG. 4, an exploded perspective view of a retrofit formation of a broom ball stick in accordance with the present invention is shown. It should be noted, however, that the ball control protrusions on the head are part of the present invention and are discussed in more detail below.

The combined reinforcement shaft 56 and reinforcement and stabilizing material 58 are inserted in the non-tapered end of shaft 52 and pushed forward until the reinforcement shaft protrudes from the tapered end of shaft 52. Glue 64 is provided within the tapered region of shaft 52 adjacent the reinforcement shaft. Glue 64' is then inserted into the drilled out hole in head 54 and shaft 52 with the reinforcement shaft protruding therefrom is inserted into the head and forced downward therein until the protruding region of reinforcement shaft 56 enters the bore hole 63 formed in extender 62. The new shaft 52 may be secured by inserting glue into the head before the new shaft is inserted therein and/or by affixing a bolt through the head and new shaft.

Figure 5:
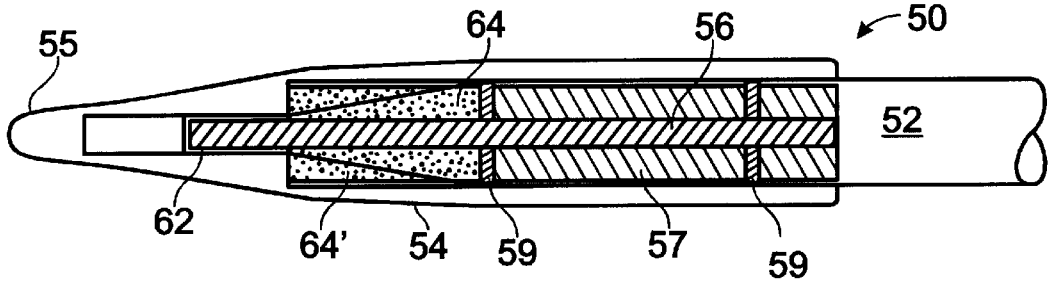
FIG. 5 is a side longitudinal view of the retrofit broom ball stick of FIG. 2 in accordance with the present invention.

Referring to FIG. 5, a side longitudinal view of the retrofit broom ball stick of FIG. 2 in accordance with the present invention is shown. In addition to aspects illustrated in FIG. 2, FIG. 5 provides a side view of the tapered end of shaft 52. The placement of reinforcement shaft 56 within extender 62 and the overall taper of the head are also shown.

Figure 6A:
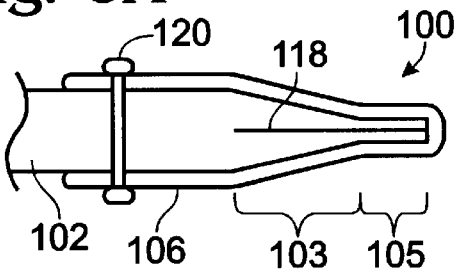
FIGS. 6A–6B illustrate one embodiment of de novo formation of a broom ball stick in accordance with the present invention.
Figure 6B:
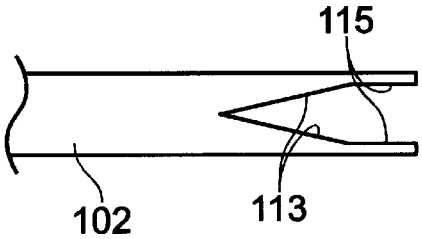

Referring to FIG. 6A, a longitudinal side view of the head region of a de novo broom ball stick 100 in accordance with the present invention is shown. Stick 100 preferably utilizes a wholly metallic or like material shaft. Like materials include various nonsolid-wood materials that are lightweight and durable. Plastic with reinforcing fibers or particles and other emerging materials are included within like materials for retrofit and de novo embodiments. The shape of shaft 102 is such that while it tapers in region 103, the distal end of the shaft includes a relatively flat non-tapering region 105. The flat regions permit head 106 to have a broad, flat or even bumped surface for contacting a broom ball and for "getting under" a broom ball such as when executing a wrist shot that is intended to lift the ball.

Referring to 6B, a longitudinal side view of shaft 102 after being cut but before bending is shown. Shaft 102 is cut to have first side surfaces or edges 115 and second side surfaces or edges 113. Surfaces or edges 115 are cut at an angle that is substantially horizontal but which compensates for the radial affect of surfaces 113 (during bending) in such a manner as to achieve the horizontal arrangement of section 105 after bending. Surfaces 113 are cut at an angle and length that provides a desired taper. The cut end of shaft 102 is then bent to form the structure illustrated in FIG. 6A. Opposing side surfaces 113 and 115 are then welded in place. The weld is indicated with reference number 118. Head 106 is then formed about the tapered end. Fill material (such as plastic or glue or the like) may be provided in the tapered region to provide structural support and stick stability.

Also, while the formation of two tapered or shaped sections 103,105 is preferred, the present invention includes formation of a single tapered or shaped region such as region 103 and the formation of more than two tapered or shaped regions. A bolt 120 may be provided in addition to glue to securely retain head 106 on shaft 102.

Figure 7A:
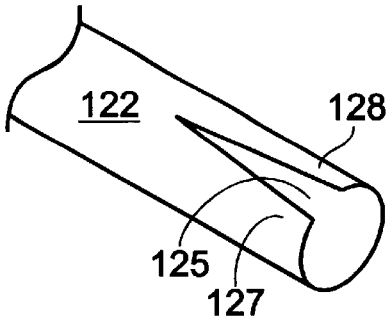
FIGS. 7A–7B illustrate an alternative embodiment of de novo formation of a broom ball stick in accordance with the present invention.
Figure 7B:
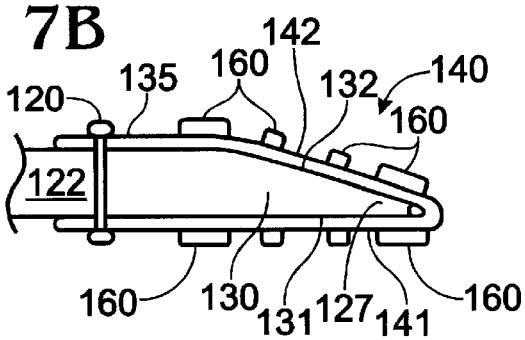

Referring to FIGS. 7A–7B, a perspective and side view of formation of an alternative broom ball stick in accordance with the present invention is shown. FIG. 7A illustrates an end on shaft 122 (preferably formed as discussed above for shafts 52,102) from which a single wedge 125 of material has been cut. The removal of wedge 125 forms two flaps 127,128. These flaps are then folded down to produce an end 130 which has one surface 131 that is substantially flat and a generally opposing surface 132 that tapers towards the substantially straight surface (see FIG. 7B).

FIG. 7B illustrates the head end 140 of a broom ball stick that has a shaft made in the manner described above with reference to FIG. 7A. A head 135 (as described above) is preferably formed over shaft 122. The conforming of the head to the shaft produces a head that has one surface 141 that is substantially straight and another, generally opposing, surface 142 that is tapered. Surface 141 which is less tapered (or preferably substantially straight) than conventional sticks is advantageous for backhand shots and the like and permits a player to achieve better lift on the ball, etc.

Referring to FIGS. 4 and 7B, ball control protrusions in accordance with the present invention are shown. FIG. 4 illustrates ball control protrusions 160. These protrusions are preferably provided around the broad surfaces of the head and serve both to center a ball on the broad surfaces and to provide enhance ball control.

FIG. 7B illustrates a side view of these protrusions. They are approximately ⅛" in height and preferably vary in height such that they are higher towards the periphery of the broad surfaces than towards the center so as to facilitate centering the ball on the broad surfaces.

It is apparent from FIGS. 6A and 7B, for example, that shafts 102, 122 preferably extend at least approximately ¾ of the way into their respective heads. It is also apparent from these figures that the shafts 102,122 preferably have at their head ends a tapered surface that is approximately 30 degrees or less out of plane with a plane parallel to the longitudinal axis of the shaft.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A broom ball stick apparatus, comprising:

a substantially bristleless broom ball head having a longitudinal axis;

a singular substantially metallic and substantially hollow shaft having a handle region, a head region and shaft wall, said head region being inserted at least approximately ⅝th way into said head along the direction of said longitudinal axis wherein said head region of said shaft includes a tapered section in which portions of the shaft wall are bent towards cross-sectionally opposing portions of the shaft wall;

the tapered section being characterized in that at a beginning of the tapered section, the cross-sectional configuration of the shaft defines a given cross-sectional area and at a more distal end of the tapered section, the cross-sectional configuration of the shaft is flatter and more linear due to the compression of at least one opposing shaft wall portion towards another.

2. The apparatus of claim 1, wherein said tapered section includes a first surface of said shaft that is tapered and a generally opposing second surface of said shaft that is substantially non-tapered.

3. The apparatus of claim 1, wherein said tapered section includes a first tapered surface and the angle of that surface is approximately 30 degrees or less out of plane with a plane parallel to said longitudinal axis of the shaft.

4. The apparatus of claim 1, wherein said tapered section includes a first tapered surface that is disposed longitudinally between the beginning of said tapered section and a less tapered surface located toward a distal end of said head region.

5. The apparatus of claim 1, wherein a reinforcement member is provided within and extends from said head end of said shaft.

6. The apparatus of claim 1, wherein said tapered section is formed by removal of a portion of said shaft wall at said tapered section and compression of a remaining wall portion in such a manner as to achieve the taper.

7. The apparatus of claim 1, wherein said head region of said shaft is inserted at least approximately ¾ way into said head generally along the direction of the longitudinal axis of the head, the tapered section includes a first tapered surface and the angle of that surface is approximately 30 degrees or less out of plane with a plane parallel to said longitudinal axis of the shaft, and the cross-sectional area at the beginning of the tapered section is greater than that at the more distal end.

8. The apparatus of claim 1, wherein said tapered section has provided therewith structural integrity enhancing means for enhancing the structural integrity of the bent wall portions, said means being from the group of structural integrity enhancing means including:

a weld;

glue; and formed plastic.

9. A method of forming a broom ball stick, comprising the steps of:

providing a substantially non-wood and substantially hollow shaft having a shaft wall, and defining on said shaft a handle region and a head region;

creating a tapered section in said head region by bending a portion of a shaft wall in said head region towards a cross-sectionally opposing portion of the shaft wall, said tapered section having a beginning and a distal end, the cross-sectional area of the shaft at the distal end being flatter and more linear than that at the beginning; and inserting said head region of said shaft approximately ⅝th way or more into a substantially bristleless broom ball head along the longitudinal axis of that head.

10. The method of claim 9, further comprising the step of removing a portion of the shaft wall adjacent the portion of the shaft wall that is bent towards a cross-sectionally opposing portion, and removing this portion prior to executing the bending step.

11. The method of claim 9, further including the step of creating a first tapered surface in said tapered section and forming said surface to be approximately 30 degrees or less out of plane with a plane parallel to said longitudinal axis; and providing a fastening means adjacent said tapered section that enhances the structural integrity of the tapered section.

12. A head apparatus for a broom ball stick, comprising:

a body having a shaft receiving cavity and a first and a second broad surface disposed exteriorly and generally opposite one another; and a plurality of ball control protrusions formed on at least one of said broad surfaces;

wherein said ball control protrusions have a height that increases with distance from an approximate center of the broad surface on which the protrusions are formed.

13. The apparatus of claim 12, wherein said ball control protrusions are arranged about a center portion of said one of said broad surfaces and function to center a ball on that broad surface.

14. The apparatus of claim 12, wherein said ball control protrusions have a height of at least approximately ⅛th of an inch.

15. An apparatus for use in broom ball, comprising:

a substantially non-wood shaft having a handle end and a head end;

a substantially bristleless broom ball head fixed at the head end of said shaft; and a reinforcement member provided within and extending from said head end of said shaft;

wherein said head end of said shaft and said reinforcement member are inserted substantially more than halfway into said broom ball head.

16. The apparatus of claim 15, wherein the head end of said shaft has a first tapered surface formed substantially in a plane that is less than approximately 40 degrees out of plane with a commonly oriented plane running longitudinally through said shaft.

17. The apparatus of claim 16, wherein said first tapered surface has provided adjacent thereto fastening means from the group of fastening means including:

a weld;

glue; and formed plastic.

* * * * *